US005693262A

United States Patent [19]

Percival

[11] Patent Number: 5,693,262

[45] Date of Patent: Dec. 2, 1997

[54] ADJUSTABLE FUEL METERING ADAPTER FOR CARBURETOR

[76] Inventor: Jeffrey D. Percival, P.O. Box 382, Camdenton, Mo. 65020

[21] Appl. No.: 778,094

[22] Filed: Jan. 2, 1997

Related U.S. Application Data

[63] Continuation-in-part of Ser. No. 525,966, Aug. 9, 1995, abandoned.

[51] Int. Cl.[6] ..... F02M 19/06

[52] U.S. Cl. ..... 261/23.2; 261/34.1

[58] Field of Search ..... 261/23.2, 34.1

[56] References Cited

U.S. PATENT DOCUMENTS

| | | | |
|---|---|---|---|
| 1,186,797 | 6/1916 | Kingston | 261/23.2 |
| 1,809,108 | 6/1931 | Chesnutt | 261/DIG. 38 |
| 2,296,697 | 9/1942 | Ball | 261/23.2 |
| 3,807,707 | 4/1974 | Johnson | 261/34.1 |
| 4,275,015 | 6/1981 | Von Delden | 261/34.1 |
| 4,277,423 | 7/1981 | Noguez | 261/34.1 |
| 5,591,383 | 1/1997 | Krup | 261/34.1 |

*Primary Examiner*—Tim R. Miles

*Attorney, Agent, or Firm*—Litman, McMahon and Brown, L.L.C.

[57] ABSTRACT

An adjustable fuel metering adapter for a carburetor includes a rectangular plate having an inlet surface and an opposite outlet surface. A needle valve chamber with a needle valve seat is formed within the plate and communicates with a threaded needle valve bore formed through a top edge surface of the plate. A pair of inlet ports are bored into the inlet surface of the plate, and a pair of outlet ports are bored into the outlet surface of the plate. A pair of inlet passages communicate respectively between the inlet ports and the needle valve chamber. A pair of outlet passages communicate between the needle valve chamber and the respective outlet ports. The inlet ports receive fuel from the fuel bowl of the carburetor, and the outlet ports are positioned to align with fuel supply passages of the carburetor. Rotation of a needle valve member received in the needle valve bore simultaneously controls the volume rate of fuel flow from the fuel bowl to the respective fuel outlet ports.

13 Claims, 2 Drawing Sheets

ADJUSTABLE FUEL METERING ADAPTER FOR CARBURETOR

CROSS-REFERENCE TO RELATED APPLICATION

This is a continuation-in-part of application Ser. No. 08/525,966 filed Aug. 9, 1995 entitled ADJUST-A-JET, which is now abandoned.

BACKGROUND OF THE INVENTION

Auto racing has many forms. In most forms, sanctioning bodies determine the rules which competitors must follow to participate. It is generally preferable to have competitors with roughly similar levels of skill and equipment compete in a given race. Such rules ensure that unskilled racers do not endanger other competitors or that one vehicle does not have an unfair advantage in terms of performance enhancing equipment which is not available to other competitors. Many racing classes require that the engines be "normally aspirated", that is, that they use carburetors.

Holley brand carburetors are preferred by many car owners, racers, and mechanics because of their availability, versatility, reliability, and other reasons. Calibration or metering of such carburetors is by the use of "jets". A jet is a removable structure having an orifice which determines the maximum rate of fuel flow into the carburetor for mixing with air. A jet controls fuel flow from the fuel bowl of the carburetor to each venturi of the carburetor. There are jets available for most Holley brand carburetors in wide ranges of orifice sizes.

The "stock" jets for a given carburetor are adequate for most general driving conditions. However, automobile racers require peak performance of an engine. Carburetors provide a fuel/air mixture to an engine, based on the vacuum created on the intake cycles of the cylinders, the condition of the ambient air, the orifice area of the jets, and other factors. Although operating an engine at a rich fuel/air mixture is not generally harmful to the engine, it is wasteful of fuel. On the other hand, excessively lean mixtures can cause damage to the engine and pistons as a result of backfiring or excessive combustion temperatures. Changes in the temperature, humidity, and pressure of the air can vary the fuel/air proportions, with all other factors being held constant. Such changes can vary drastically over the course of a long racing event. To compensate for changes in engine performance caused by changes in the conditions of the air, racers commonly change the jets within their carburetors.

Changing carburetor jets is time consuming, costly, wasteful, and hazardous. The gaskets which seal between the fuel bowls and the body of the carburetor must be replaced each time the jets are changed. Fuel tends to be spilled during disassembly of the carburetor, which is not only wasteful but can be dangerous as a fire hazard and as a pollutant. Because of the disadvantages involved in changing jets within an individual carburetor, racers with sufficient economic resources often set up several carburetors with different sets of jets and then switch out the entire carburetor as necessary. Although switching the entire carburetor is generally less laborious than changing the jets, the degree of performance compensation available is limited by the number of carburetors on hand.

Another problem with changing jets to improve the performance of an engine is selection of the optimum size of the jets. Racers often use expensive instruments in combination with computers to determine whether the size of jet installed is appropriate. If not, different jets must be installed and tested. Thus, peaking the performance of an engine by selecting and installing jets of the appropriate orifice size for a given set of atmospheric conditions can be strictly guesswork without test instruments or very precise with such instruments, but is laborious in either case.

Devices are known which replace the fixed size jets of Holley brand carburetors with variable metering orifices using various kinds of manually operated valves. The known types of adjustable metering devices tend to be complex in configuration and, thus, expensive to manufacture. Additionally, they tend to be difficult to set properly because of the use of an adjustment mechanism, such as a needle valve, for each jet they replace. Such multiple needle valves makes it nearly impossible to balance fuel flow to the venturis.

SUMMARY OF THE INVENTION

The present invention provides an adjustable fuel metering adapter for a carburetor which overcomes the difficulties of changing individual jets while providing an adjustment mechanism which can be controlled to precisely calibrate the fuel flow to multiple venturis of a carburetor.

The adapter of the present invention is formed by a rectangular plate having rounded edges which conform to the shape of the fuel bowl and the body of the carburetor, between which the plate is inserted. The plate has a single threaded needle valve bore machined thereinto which terminates in a needle valve chamber including a needle valve seat. Inlet ports are formed into an inlet side of the plate facing the fuel bowl, and outlet ports are formed into an opposite side facing the body of the carburetor. The outlet ports are positioned to align with fuel passages in which the jets would normally be received. Inlet passages are formed within the plate and communicate fuel between the inlet ports and the needle valve chamber. Outlet passages are formed within the plate and communicate fuel from the needle valve chamber to the outlet ports. A threaded needle valve member is received in the needle valve bore and is rotated to selectively position an end of the needle valve in relation to the needle valve seat to thereby establish an aperture or orifice between the valve end and valve seat.

The inlet and outlet sides or surfaces of the adapter plate are substantially parallel. The inlet and outlet passages extend generally parallel to the inlet and outlet surfaces and are positioned approximately centered therebetween. Edge surfaces of the adapter plate connect between the inlet and outlet surfaces. The inlet and outlet passages and the needle valve bore are drilled into the plate through the edge surfaces, and the drill holes in the edge surfaces, except for the needle valve bore, are plugged to seal the passages externally.

The inlet passages converge on the needle valve chamber and the outlet passages diverge from the needle valve chamber such that the position of the single needle valve member simultaneously controls flow of fuel from the fuel bowl to both venturis on one side of a four barrel carburetor. The needle valve is accessible external to the carburetor such that, once the adapter of the present invention is installed, fuel metering adjustments can be made without disassembling the carburetor. Adjustment of the position of the needle valve is also convenient, either with instruments or without, and only requires rotation of the needle valve to achieve the desired fuel flow to the carburetor. An angular scale may be provided on the external surface surrounding the needle valve bore to allow for coarse adjustment of the needle valve member. A lock nut is preferably provided on the needle valve member to fix it in place after adjustment.

In a modified embodiment of the fuel metering adapter of the present invention, a single inlet port and inlet passage are provided for use on vehicles intended primarily for circle track racing. In such racing, the vehicle is constantly, or nearly constantly, turning in one direction, typically to the left. Centrifugal force from such turning urges fuel in the fuel bowl radially outward from the center of the track. The modified fuel metering adapter is designed to position the single inlet port and passage on opposite side from the direction of turn, that is, on the right side of the vehicle which turns to the left. In other respects the modified fuel metering adapter is substantially similar to the preferred embodiment of the fuel metering adapter of the present invention.

OBJECTS AND ADVANTAGES OF THE INVENTION

The principal objects of the present invention are: to provide an improvement in carburetors, particularly, carburetors used in automotive racing; to provide an adjustable metering adapter for such carburetors; to provide such an adapter which decreases the waste of gaskets and fuel and increases the safety of changing the fuel metering of a carburetor; to provide such an adapter which substitutes with the replaceable jets of Holley brand and similar carburetors; to provide such an adapter which allows continuous adjustment of the fuel flowrate rather than the stepped adjustment available when changing carburetor jets; to provide such an adapter which enables adjustment of the fuel flowrate external to the carburetor whereby disassembly of the carburetor is unnecessary; to provide such an adapter which allows simultaneous adjustment of fuel flow rate to both barrels on one side of a four barrel carburetor using a single adjustment mechanism; to provide such an adapter which can be configured for a wide variety of carburetors, particularly, for various models of Holley brand carburetors; and to provide such an adjustable fuel metering adapter for carburetors which is economical to manufacture, which is precise and reliable in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
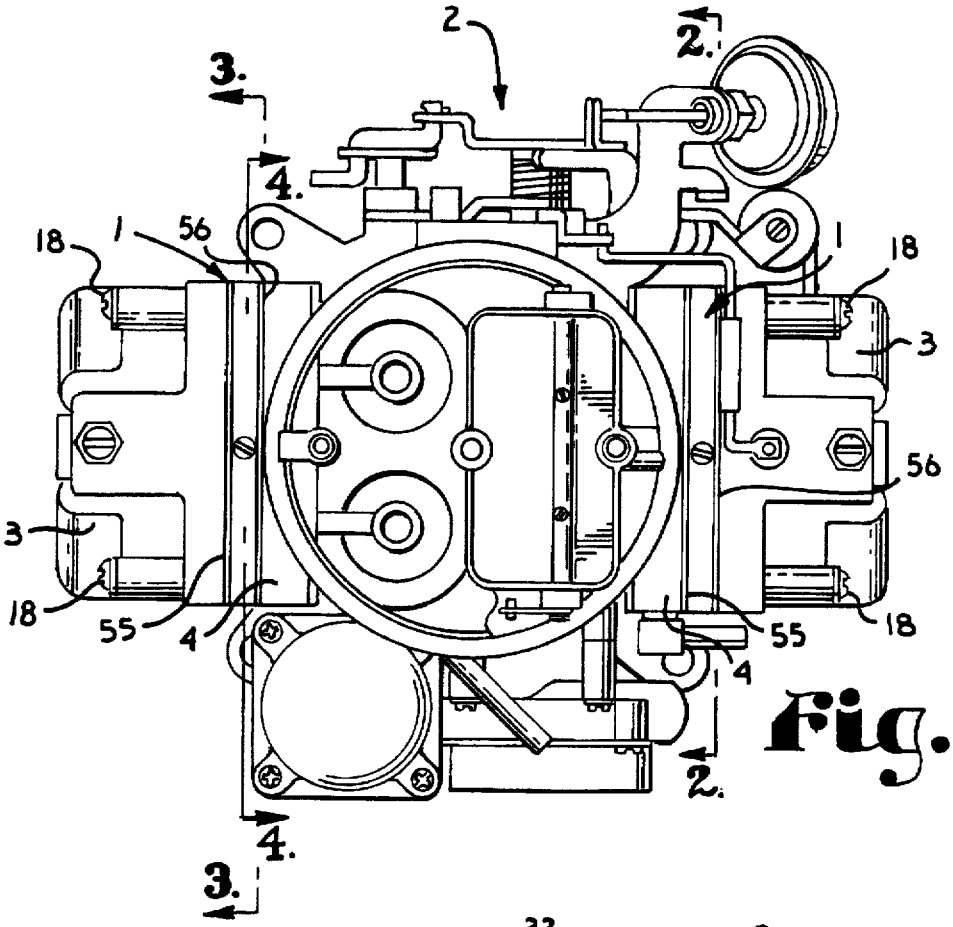
FIG. 1 is a top plan view of a carburetor incorporating the adjustable fuel metering adapter for a carburetor which embodies the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates an adjustable fuel metering adapter for a carburetor 2 which embodies the present invention. The adapter 1 is positioned between a fuel bowl unit 3 of the carburetor 2 and the body 4 of the carburetor 2 and enables adjustment of the fuel metering of the carburetor 2 to tune the performance of an engine or motor (not shown) on which the carburetor 2 is installed. The illustrated carburetor 2 is a four barrel carburetor and incorporates two adapter units 1 on opposite sides thereof between fuel bowls 3 on opposite sides of the carburetor 2 and the body 3 thereof.

Figure 2:
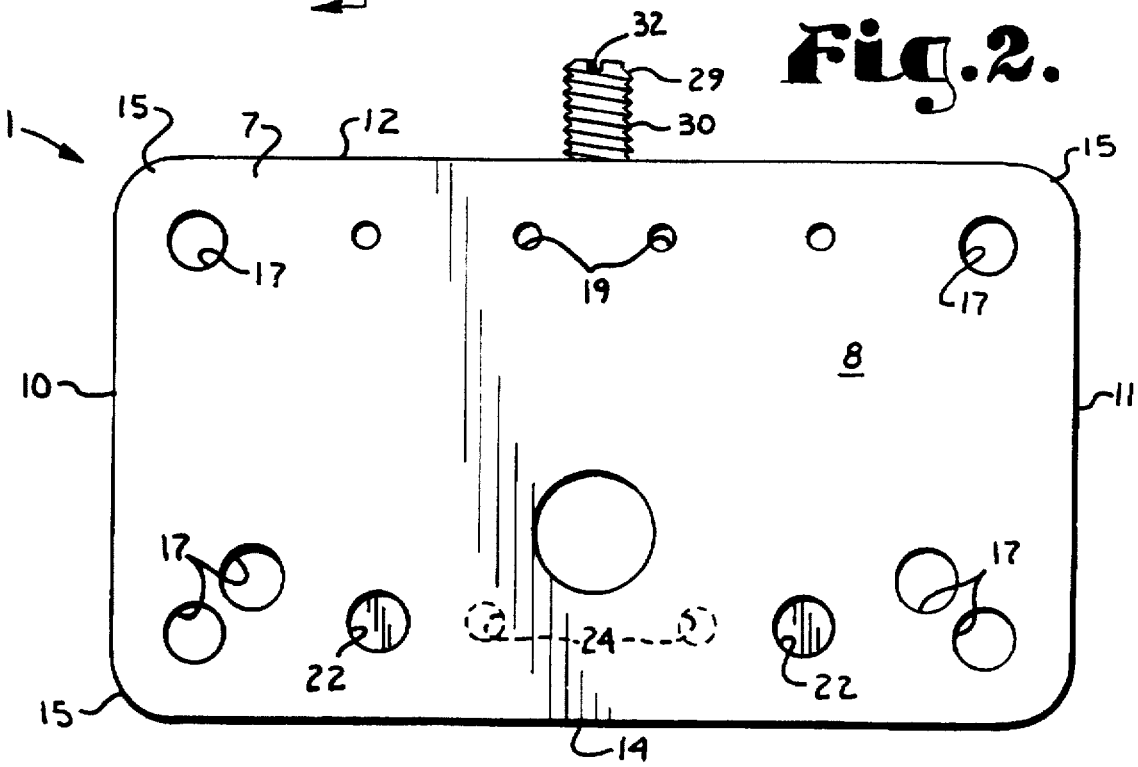
FIG. 2 is a greatly enlarged side elevational view of the adapter taken on line 2—2 of FIG. 1 and illustrates the adapter from an inlet or fuel bowl side thereof.
Figure 3:
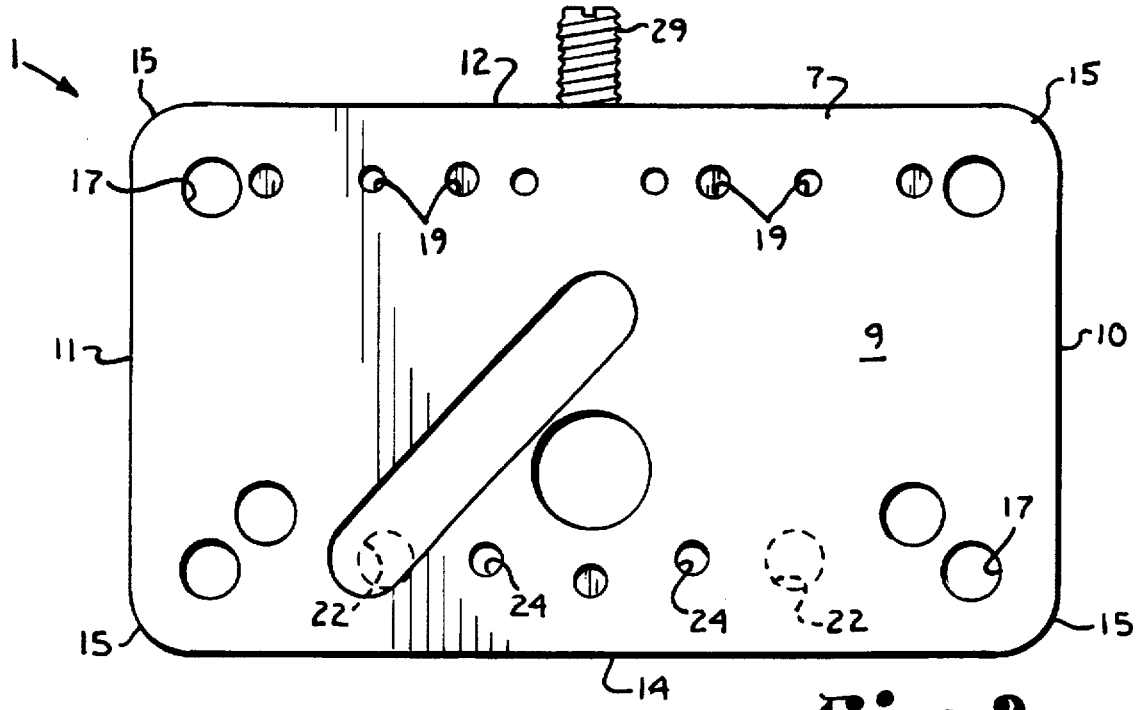
FIG. 3 is a greatly enlarged side elevational view of the adapter taken on line 3—3 of FIG. 1 and shows the adapter from an outlet or carburetor side thereof.
Figure 4:
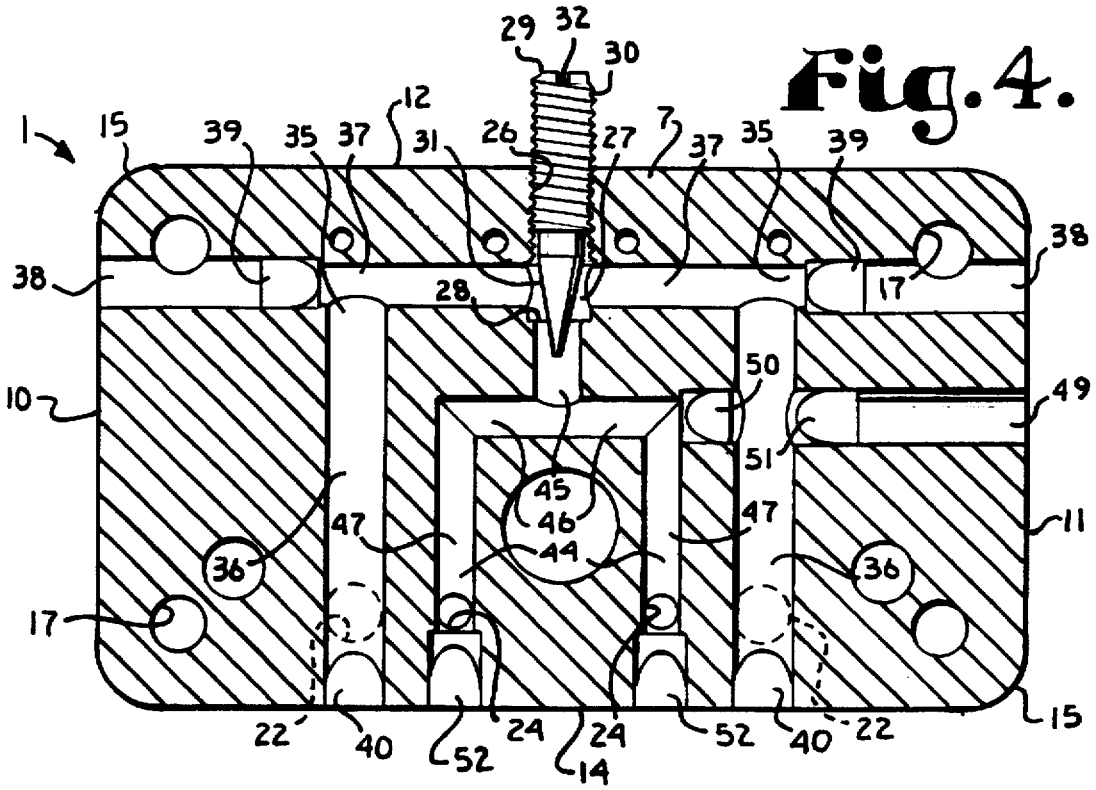
FIG. 4 is a greatly enlarged transverse sectional view taken on line 4—4 of FIG. 1 and illustrates internal passages of the adjustable fuel metering adapter for a carburetor of the present invention.

Referring to FIGS. 2–4, the adapter 1 is formed by a rectangular plate 7 having an inlet surface 8 (FIG. 2), an outlet surface 9 (FIG. 3), side edge surfaces 10 and 11, a top edge surface 12, and a bottom edge surface 14. The side edge surfaces 10 and 11 converge with the top and bottom edge surfaces 12 and 14 at radiused or rounded corners 15 which conforms the shape of the plate 7 to the shapes of the fuel bowl units 3 and the carburetor body 4. Apertures 17 are bored into the plate 7 near the corners 15 to receive fasteners 18 (FIG. 1), such as bolts, which pass through the fuel bowl units 3 and the plate 7 into the carburetor body 4. Additional bores 19, some blind and some passing entirely through the plate 7, may also be drilled into the plate 7 to receive locating pins (not shown) on the carburetor body 4 and/or the fuel bowl units 3 to properly position the plate 7 with respect to the carburetor body 4 and the fuel bowl units 3.

A pair of inlet ports 22 are bored into the inlet surface 8 of the plate 7 in spaced apart relation near the lower edge surface 14. Similarly, a pair of outlet ports 24 are bored into the outlet surface 9 near the lower edge surface 14. The inlet and outlet ports 22 and 24 are drilled into the plate 7 perpendicular to the inlet and outlet surfaces 8 and 9 respectively. A threaded needle valve bore 26 is bored into the plate 7 through the top edge surface 12 and terminates in a needle valve chamber 27 including a needle valve seat 28. A needle valve member 29 including a threaded shank 30, a conical needle valve end 31, and a screwdriver slot 32 is threaded into the needle valve bore 26.

Referring particularly to FIG. 4, a pair of inlet passages 35 are formed within the plate 7. Each inlet passage 35 includes an ascending inlet passage 36 and a transverse passage 37. The transverse passages 37 are formed by transverse bores 38 through the side edge surfaces 10 and 11. The transverse bores 38 may be counterbored and are then sealed by plugs 39. The ascending passages 36 are bored through the lower edge surface 14 and sealed by plugs 40. The ascending passages 36 intersect the inlet ports 22 and the transverse passages 37. The transverse passages 37 intersect the needle valve chamber 27. Thus, the inlet ports 22 ultimately communicate fuel from the fuel bowl 3 to the needle valve chamber 27.

In a similar manner, outlet passages 44 are formed within the plate 7. The outlet passages 44 are formed by a central outlet passage 45 which diverges into transverse outlet passages 46 which further communicate with descending outlet passages 47 leading to the outlet ports 24. The central outlet passage 45 is an extension of the needle valve bore 26. The transverse outlet passages 46 are formed by a transverse bore 49 through one of the side edge surfaces, such as the surface 11. The transverse bore 49 is sealed on opposite sides one of the ascending inlet passages 36 by plugs 50 and 51. The descending outlet passages 40 are formed by bores through the lower edge surface 14. The passages 40 may be counterbored and are sealed by plugs 52.

In operation, a plate 7 is installed on the carburetor 2 between the fuel bowl unit 3 on each side thereof. A fuel bowl gasket 55 (FIG. 1) seals between the fuel bowl unit 3 and the inlet surface 8 of the plate, while a carburetor body gasket 56 seals between the outlet surface 9 of the plate 7 and the carburetor body 4. Once the adapter plate 7 has been installed, adjustment of the fuel metering of the carburetor 2 is accomplished by rotating the needle valve member 29 to vary the spacing between the conical end 31 of the needle valve member 29 and the needle valve seat 28 within the needle valve chamber 27. Such adjustment varies the orifice area between the transverse inlet passages 37 and the central outlet passage 45 and, thus, controls the volume flow rate of fuel therethrough.

The preferred embodiment of the fuel metering adapter 1 of the present invention is suitable for most forms of racing and for general driving purposes. The adapter 1 can also be provided in a configuration especially suited for circle track racing. Such a configuration is provided with only one set of an inlet port 22 and inlet passage 35. In all other respects, the circle track configuration is substantially to the fuel metering adapter 1 described and illustrated.

It is to be understood that while certain forms of the present invention have been illustrated and described herein, it is not to be limited to the specific forms or arrangement of parts described and shown.

What is claimed and desired to be secured by Letters Patent is as follows:

1. An adjustable fuel metering apparatus for adjustable control external to the carburetor of a flowrate of fuel from a fuel bowl of the carburetor to a pair of fuel supply passages of the carburetor, said apparatus comprising:

(a) a substantially solid rectangular plate having an inlet surface adapted to be oriented toward a fuel bowl of a carburetor and an opposite outlet surface adapted to be oriented toward a pair of fuel passages of the carburetor;

(b) a needle valve chamber formed within said plate and including a needle valve seat;

(c) at least one fuel inlet passage formed within said plate, communicating between said inlet surface and said needle valve chamber, and adapted to communicate fuel from a fuel bowl of the carburetor to said needle valve chamber;

(d) a plurality of fuel outlet passages formed within said plate, communicating between said needle valve chamber and said outlet surface, and adapted to communicate fuel from said needle valve chamber to corresponding fuel supply passages of the carburetor;

(e) a single threaded needle valve bore formed into said plate in communication with said needle valve chamber, said needle valve bore being positioned and oriented to enable access thereto external to said carburetor; and (f) a threaded needle valve member positioned within said needle valve bore and having a valve end, said needle valve member being rotatable within said bore to position said valve end in a selected spaced relation to said needle valve seat to thereby control the flowrate of fuel from said inlet passage to said outlet passages.

2. An apparatus as set forth in claim 1 wherein said fuel inlet passage is a first fuel inlet passage, and including:

(a) a second fuel inlet passage formed within said plate and communicating between said inlet surface of said plate and said needle valve chamber.

3. An apparatus as set forth in claim 1 wherein:

(a) a fuel inlet port is formed into said inlet surface of said plate and positioned to receive fuel from the fuel bowl, said inlet port communicating with said inlet passage.

4. An apparatus as set forth in claim 1 wherein:

(a) a pair of fuel outlet ports are formed into said outlet surface of said plate in spaced apart relation and positioned to communicate fuel respectively to said fuel supply passages of said carburetor, said outlet ports communicating respectively with said outlet passages.

5. An apparatus as set forth in claim 1 wherein:

(a) said inlet surface and said outlet surface are substantially parallel; and (b) said inlet passage and said outlet passages extend substantially parallel to said inlet and outlet surfaces.

6. An apparatus as set forth in claim 1 wherein:

(a) said plate has peripheral surfaces extending between said inlet surface and said outlet surface;

(b) said inlet passage and said outlet passages are formed by respective bores machined through said peripheral surfaces; and (c) respective sealing plugs are received into said bores adjacent said peripheral surfaces to seal said inlet passage and said outlet passages from said peripheral surfaces.

7. An adjustable fuel metering apparatus for replacement of fixed fuel metering jets of a carburetor to enable adjustable control external to the carburetor of a flowrate of fuel from a fuel bowl of the carburetor to a pair of fuel supply passages of the carburetor, said apparatus comprising:

(a) a substantially rectangular plate having substantially continuous opposite surfaces including an inlet surface adapted to be oriented toward a fuel bowl of a carburetor and an opposite outlet surface adapted to be oriented toward a pair of fuel passages of the carburetor;

(b) a needle valve chamber formed within said plate and including a needle valve seat;

(c) a fuel inlet port formed into said inlet surface of said plate and positioned to receive fuel from the fuel bowl;

(d) a fuel inlet passage formed within said plate and communicating between said fuel inlet port and said needle valve chamber;

(e) a pair of fuel outlet ports formed into said outlet surface of said plate in spaced apart relation and positioned to communicate fuel respectively to said fuel supply passages of said carburetor;

(f) a pair of fuel outlet passages formed within said plate and communicating between said needle valve chamber and respective ones of said fuel outlet port;

(g) a single threaded needle valve bore formed into said plate in communication with said needle valve chamber, said needle valve bore being positioned and oriented to enable access thereto external to said carburetor; and (h) a threaded needle valve member positioned within said needle valve bore and having a valve end, said needle valve member being rotatable within said bore to position said valve end in a selected spaced relation to said needle valve seat to thereby control the flowrate of fuel from said inlet passage to said outlet passages.

8. An apparatus as set forth in claim 7 wherein said fuel inlet port and said fuel inlet passage are respectively a first fuel inlet port and a first fuel inlet passage, and including:

(a) a second fuel inlet port formed into said inlet surface of said plate in spaced relation to said first fuel inlet port, said second fuel inlet port being positioned to receive fuel from the fuel bowl; and (b) a second fuel inlet passage formed within said plate and communicating between said second fuel inlet port and said needle valve chamber.

9. An apparatus as set forth in claim 7 wherein:

(a) said inlet surface and said outlet surface are substantially parallel;

(b) said fuel inlet port and said fuel outlet ports are bored into said plate substantially perpendicular to said inlet and outlet surfaces; and (c) said inlet passage and said outlet passages extend substantially parallel to said inlet and outlet surfaces.

10. An apparatus as set forth in claim 7 wherein:

(a) said plate has peripheral surfaces extending between said inlet surface and said outlet surface;

(b) said inlet passage and said outlet passages are formed by respective bores machined through said peripheral surfaces; and (c) respective sealing plugs are received into said bores adjacent said peripheral surfaces to seal said inlet passage and said outlet passages from said peripheral surfaces.

11. An adjustable fuel metering apparatus for replacement of fixed fuel metering jets of a carburetor to enable adjustable control external to the carburetor of a flowrate of fuel from a fuel bowl of the carburetor to a pair of fuel supply passages of the carburetor, said apparatus comprising:

(a) a substantially rectangular plate having substantially continuous opposite surfaces including an inlet surface adapted to be oriented toward a fuel bowl of a carburetor and an opposite outlet surface adapted to be oriented toward a pair of fuel passages of the carburetor, said inlet surface and said outlet surface being substantially parallel;

(b) a needle valve chamber formed within said plate and including a needle valve seat;

(c) a fuel inlet port formed substantially perpendicularly into said inlet surface of said plate and positioned to receive fuel from the fuel bowl;

(d) a fuel inlet passage formed within said plate and extending substantially parallel to said inlet and outlet surfaces to communicate between said fuel inlet port and said needle valve chamber;

(e) a pair of fuel outlet ports formed substantially perpendicularly into said outlet surface of said plate in spaced apart relation and positioned to communicate fuel respectively to said fuel supply passages of said carburetor;

(f) a pair of fuel outlet passages formed within said plate and extending substantially parallel to said inlet and outlet surfaces to communicate between said needle valve chamber and respective ones of said fuel outlet port;

(g) a single threaded needle valve bore formed into said plate in communication with said needle valve chamber, said needle valve bore being positioned and oriented to enable access thereto external to said carburetor; and (h) a threaded needle valve member positioned within said needle valve bore and having a valve end, said needle valve member being rotatable within said bore to position said valve end in a selected spaced relation to said needle valve seat to thereby control the flowrate of fuel from said inlet passage to said outlet passages.

12. An apparatus as set forth in claim 11 wherein said fuel inlet port and said fuel inlet passage are respectively a first fuel inlet port and a first fuel inlet passage, and including:

(a) a second fuel inlet port formed into said inlet surface of said plate in spaced relation to said first fuel inlet port, said second fuel inlet port being positioned to receive fuel from the fuel bowl; and (b) a second fuel inlet passage formed within said plate and communicating between said second fuel inlet port and said needle valve chamber.

13. An apparatus as set forth in claim 12 wherein:

(a) said plate has peripheral surfaces extending between said inlet surface and said outlet surface;

(b) said inlet passage and said outlet passages are formed by respective bores machined through said peripheral surfaces; and (c) respective sealing plugs are received into said bores adjacent said peripheral surfaces to seal said inlet passage and said outlet passages from said peripheral surfaces.

* * * * *